US012151153B2

(12) United States Patent
Yoon

(10) Patent No.: US 12,151,153 B2
(45) Date of Patent: Nov. 26, 2024

(54) GOLF ALIGNMENT STICKS WITH BUILT-IN COUPLING MECHANISM

(71) Applicant: Hojun Yoon, Canyon Country, CA (US)

(72) Inventor: Hojun Yoon, Canyon Country, CA (US)

( * ) Notice: Subject to any disclaimer, the term of this patent is extended or adjusted under 35 U.S.C. 154(b) by 50 days.

(21) Appl. No.: 17/817,655

(22) Filed: Aug. 5, 2022

(65) Prior Publication Data

US 2024/0042299 A1 Feb. 8, 2024

(51) Int. Cl.
*A63B 69/36* (2006.01)
*A63B 71/06* (2006.01)

(52) U.S. Cl.
CPC .. *A63B 69/3667* (2013.01); *A63B 2071/0694* (2013.01); *A63B 2209/02* (2013.01); *A63B 2209/08* (2013.01); *A63B 2225/09* (2013.01)

(58) Field of Classification Search
CPC ..... A63B 69/3667; A63B 2209/08
See application file for complete search history.

(56) References Cited

U.S. PATENT DOCUMENTS 2,150,580 A * 3/1939 Crowley ..... A63B 69/3667 33/508
7,037,210 B2 * 5/2006 Bainter ..... A63B 69/3667 473/270
8,246,482 B1 * 8/2012 Kim ..... A63B 69/3667 473/218
9,259,635 B2 2/2016 Downing
11,000,749 B1 * 5/2021 Forney ..... A63B 69/3682
11,202,950 B2 12/2021 Russo
2015/0005092 A1 * 1/2015 Bolen ..... A63B 69/3685 473/238
2020/0306611 A1 * 10/2020 Russo ..... A63B 69/3667

FOREIGN PATENT DOCUMENTS

KR 20090098008 A * 3/2008
KR 20210069818 A * 12/2019

OTHER PUBLICATIONS

Momentus, "Momentus Deluxe Alignment Sticks", Mar. 30, 2014 (Year: 2014).*

* cited by examiner

*Primary Examiner* — Joshua T Kennedy

(57) ABSTRACT

A golf training apparatus comprises of a pair of golf alignment sticks equipped with a coupling mechanism based on loosely fitting sleeves that can freely slide along the length of the sticks and freely rotate around the axis of the sticks. A second coupling mechanism is included that is similar to the first but is positioned in a fixed location and made to be non-sliding in its position. The combined features produce a golf training aid that is highly functional, user-friendly and convenient to use, thereby encouraging frequent use of the product.

10 Claims, 5 Drawing Sheets

Prior Art

GOLF ALIGNMENT STICKS WITH BUILT-IN COUPLING MECHANISM

CROSS-REFERENCE TO RELATED APPLICATIONS

Not Applicable

BACKGROUND OF THE INVENTION

Golf alignment sticks are one of the simplest and most widely used golf training apparatus used by golfers of all skill levels—amateurs and professionals alike. As the name suggests, the apparatus consists of a stick or sticks, primarily used by placing them on the ground as a visual guide to help the user (golfer) achieve proper alignment. While one or more sticks can be used to serve different purposes, using two alignment sticks is a common and preferred way to help achieve proper body alignment and feet position. By laying down two sticks on the ground, with one aimed at the target and the second placed on top and perpendicular to the first and pointing to the golf ball, the golfer is provided with visual aids that help to properly align his/her body and position the feet relative to the golf ball. FIG. 2 helps to visualize the aforementioned description: a golfer aligns his body towards the target (flag stick) using one stick 100 aimed towards the target (as indicated by the dashed arrow pointing to the flag stick) and his feet position relative to the golf ball using another stick 200 that is placed perpendicular to the first stick and pointing to the golf ball 500 (as indicated by the two short arrows near the feet).

While the previously described product usage arrangement (i.e., two sticks arranged perpendicular to each other in a "cross"-like arrangement on the ground) can be achieved using golf alignment sticks that are presently available on the market, they lack design features that promote user-friendliness and functionality, thereby limiting a more widespread usage of such products. For example, when a stick is simply placed on top of another, it can easily move during usage because the two sticks are not secured to each other, and often need to be adjusted.

Additionally, users of golf alignment sticks especially when two sticks are involved, have the desire to keep them together during storage and handling, primarily for organizational and convenience purposes. The present invention offers a solution to this situation by adding a second coupling mechanism that helps to secure and maintain the two sticks together during storage and handling.

The invention herein incorporates simple yet unique mechanical features into ordinary golf alignment sticks, producing a built-in coupling mechanism that transforms them into an improved product that is more convenient to use and highly functional.

BRIEF SUMMARY OF THE INVENTION

The first embodiment of the present invention comprises of a pair of golf alignment sticks each having at least one freely sliding sleeve (along the axis of the stick) that serves as a coupling mechanism. The freely sliding sleeves are also able to freely rotate around the axis of the sticks. The coupling mechanism allows the two sticks to be easily, conveniently, and securely arranged for example, perpendicular to each other while placed on the ground. The coupling mechanism can be based on any suitable mechanical method but the preferred method is based on magnetic coupling, achieved by integrating a magnet onto the freely sliding sleeve from one or both of the sticks. Once the magnetic coupling mechanism is engaged (simply by bringing the two sleeves together such that the magnetic force intimately couples the two sleeves together), the two freely sliding sleeves are coupled to each other yet the sticks can be easily moved relative to each other while being intimately connected to each other through the magnetic coupling. More specifically, when the user places the two sticks on the ground in the approximately desired positions with the coupling mechanism engaged, the two sticks remain securely connected yet become easily and conveniently adjustable into the final configuration. During subsequent usage of the product, the user continues to enjoy the convenience and ease with which the sticks can be adjusted, enabled by the coupling mechanism. Separating or decoupling the sticks is simply done by pulling the two sticks apart.

The second embodiment of the present invention incorporates yet a second coupling mechanism to the first embodiment, where the primary purpose of the second coupling mechanism is to aid in keeping the two sticks together when not in use, for example while stored in a golf bag. This second coupling mechanism is constructed in the same manner as the first coupling mechanism described in the first embodiment, but unlike the first coupling mechanism, the second coupling mechanism is made to be non-sliding along the sticks. Moreover, the sleeves that make up the second coupling mechanism are positioned near one end of the sticks in such a way that they do not appreciably slide along the length of the sticks, but able to rotate freely around the axis of the sticks.

DETAILED DESCRIPTION OF THE INVENTION

Prior Art

Figure 1:
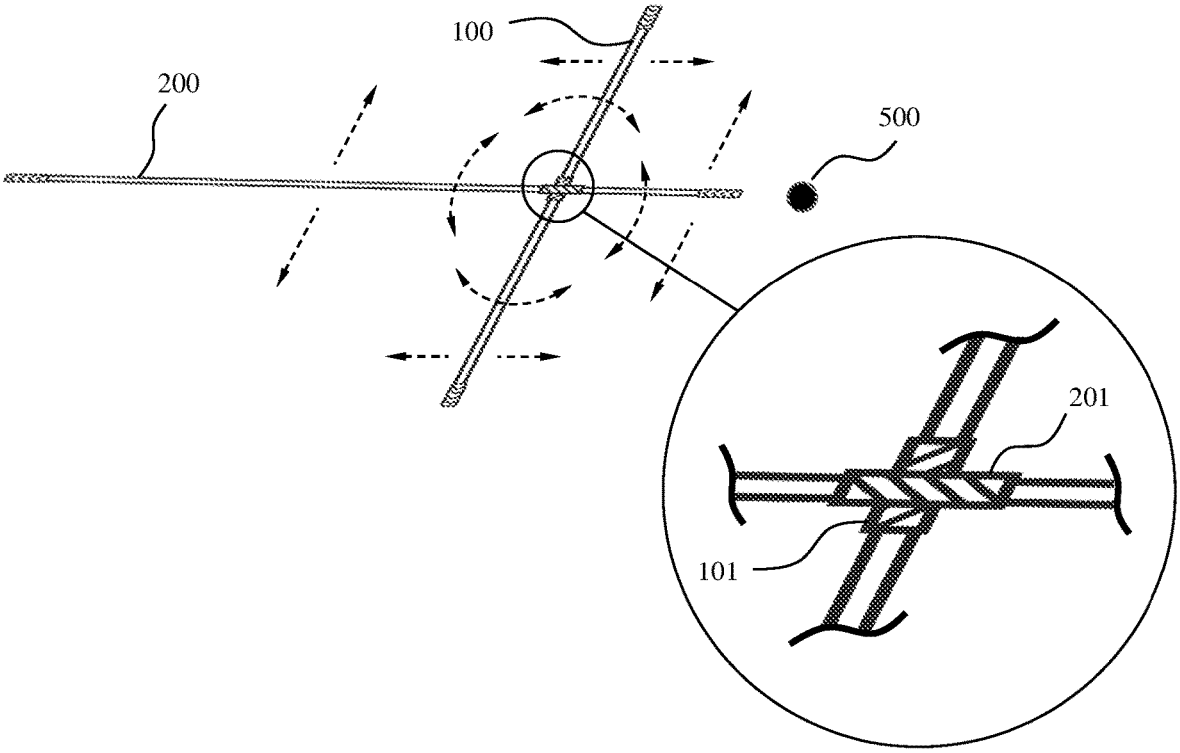
FIG. 1: Schematic configuration of the golf alignment stick apparatus according to one of the preferred embodiments of the present invention.

The most widely available golf alignment sticks based on prior art have no unique design features that facilitate coupling of two sticks together. The most common product for example, consists of a pair of identical fiberglass sticks that are about 48 inches long and about 0.3 inch in diameter. The sticks are often furnished with some markings along the sticks that can serve as visual aids but no other functional features are incorporated—in particular, features that serve to promote using two sticks arranged in a cross-like configuration in a convenient and secure manner. While two such prior art sticks can be placed into a cross-like configuration simply by placing one stick on top of the other in a perpendicular manner, the top stick is prone to movement and often necessitates the user to reposition the stick during usage, actions that are undesired and non-value added.

An example prior art that aims to provide a solution for securing two basic golf alignment sticks together in a perpendicular manner uses a separate mechanical assembly such as the one described in the reference [U.S. Pat. No. 9,259,635B2]. While this approach may provide secure positioning of the sticks, disadvantages include inconveniences associated with having to set up the assembly, the inability to easily make adjustments, and having to always carry and maintain the separate assembly. Yet there are other more complex designs that attempt to achieve this purpose using elaborate mechanical systems, for example as described in the reference [U.S. Pat. No. 8,246,482B1], but not only do they use different mechanical assemblies than the present invention, they are also entirely separate devices that do not incorporate the basic golf alignment sticks.

No prior art exists that leverages magnets for the purpose of connecting or coupling two or more golf alignment sticks together in the manner prescribed by the present invention. One prior art [U.S. patent Ser. No. 11/202,950B2] that uses magnets for the purpose of coupling the two sticks together (and not for product operational purpose) embeds the magnets inside the endcaps, which is not contemplated in the present invention.

Technical Solution

The present invention transforms ordinary pair of golf alignment sticks into a product that is far more functional, useful, and effective as a golf training aid. A particularly useful way in which a pair of ordinary golf alignment sticks are used is to place them on the ground in a cross-like configuration to visually aid the user to align his/her body along the target line and position the feet properly relative to the ball (as described in the Background section and depicted in FIG. 2). The present invention integrates simple sliding sleeves into ordinary golf alignment sticks with a magnetically based coupling mechanism that allows the user to easily, quickly, and securely arrange two sticks on the ground in the cross-like configuration described above. During subsequent usage of the apparatus, the coupling mechanism further provides the means to easily adjust the positions of the sticks. Separating or de-coupling the sticks is easily achieved by pulling the two sticks apart. The invention further integrates an additional coupling mechanism based on non-sliding sleeves that help to conveniently and securely keep the two sticks together during storage or handling.

Benefits of the Invention

The present invention offers multiple benefits to the user. First, the simple but unique coupling mechanism created by the sliding sleeves of the two sticks provides a highly functional feature that allows the user to easily, quickly, and securely arrange the two sticks on the ground, to be used for aligning the body and feet in the proper positions prior to making a golf swing. An additional unique feature comprising of a second coupling mechanism integrated into non-sliding sleeves of the two sticks further provides a highly functional feature that allows the two sticks to be conveniently and securely attached to each other during for example, handling, transport, and storage. In short, the ease and convenience derived from these unique features greatly promote the use of the apparatus.

BEST MODES OF OPERATION OF THE INVENTION

The apparatus of the present invention is unique yet simple, and as such, can be described by the following primary modes of operation. Referring to the accompanying figures, the detailed description of the configuration and the mode of operation of the present invention will be presented below. In the figures, each component is indicated by a reference number, and in some cases the size of the elements in the drawings may be slightly exaggerated for purpose of clarity and convenience.

FIG. 1 shows a schematic configuration (in a perspective view) of the golf alignment stick apparatus according to one of the preferred embodiments of the present invention. This configuration is best understood with the aid of FIG. 2 which illustrates a typical way in which a golfer uses a pair of golf alignment sticks as a training aid while setting up his/her body prior to hitting the golf ball. In both figures, a pair of ordinary golf alignment sticks 100, 200 are positioned on the ground with the first stick 100 pointing to the target and the second stick 200 perpendicular to and resting partially on top of the first stick 100 while pointing to the golf ball 500. The uniqueness of the present invention is indicated by the magnified detail of the area circled in FIG. 1, showing the two sticks joined by the sliding sleeve 101 integrated into the first stick 100 and the sliding sleeve 201 integrated into the second stick 200. The sliding sleeves freely slide along the length of the sticks as well as rotate (or spin) freely around the axis of the sticks and allow the sticks to be easily and conveniently positioned and adjusted relative to each other. The joining of the sliding sleeves achieved by magnetic coupling (as will be described in FIGS. 3 and 4) effectively acts as a freely adjustable hinge point for the two sticks. In FIG. 1, the straight arrows indicate the possible lateral movements of the sticks while the curved arrows indicate the possible rotational movements of the sticks. It is noteworthy that any movement of one stick can be achieved independently of the other stick. In the subsequent paragraphs, details of the different embodiments of the present invention are described.

Figure 3A:
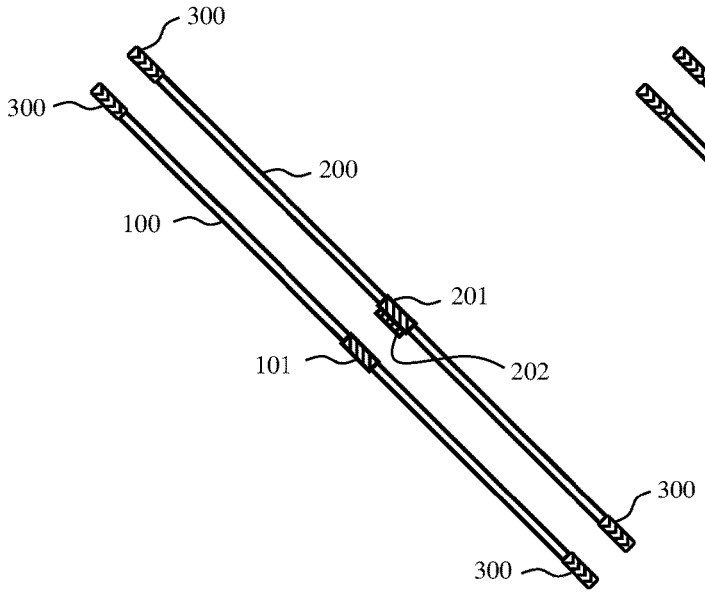
FIG. 3*a*: Illustration of one of the preferred embodiments of the present invention.

FIG. 3*a* illustrates one of the preferred embodiments of the present invention which consists of two ordinary golf alignment sticks 100 and 200 equipped with freely sliding sleeves 101 and 201, the essential element of the present invention. The freely sliding sleeves 101 and 201 are able to freely slide along the length of the sticks as well as able to freely rotate around the axis of the sticks. The apparatus consists of a first stick 100 equipped with a freely sliding sleeve 101 and a second stick 200 equipped with a freely sliding sleeve 201. The freely sliding sleeve 201 of the second stick is further equipped with a magnet 202 that can magnetically couple to the sliding sleeve 101 of the first stick. Element 300 in FIG. 3*a* represents endcaps that are commonly used in ordinary golf alignment sticks for protection purpose (sometimes referred to as protective caps). The endcaps 300 as utilized in the present invention serve an additional purpose of preventing the sliding sleeves 101 and 201 from sliding off the sticks 100 and 200.

Figure 3B:
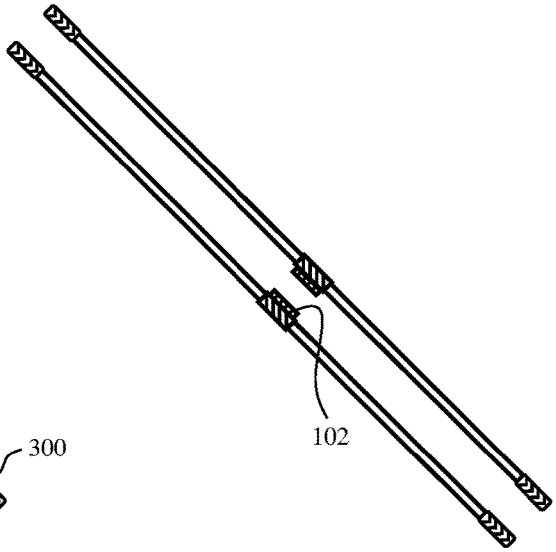
FIG. 3*b*: Illustration of another embodiment of the present invention.

FIG. 3*b* illustrates another embodiment of the present invention and functions exactly the same as the embodiment of FIG. 3*a*. The only difference is indicated by the addition of the magnet 102 onto the freely sliding sleeve 101 of the first stick 100. As such, in this configuration, the coupling of the sleeves is achieved by magnet-to-magnet coupling rather than by magnet-to-sleeve coupling. Accordingly, and for simplicity, the magnet 102 is the only element that is designated with a reference identification in FIG. 3*b*, as all other elements are same as shown in FIG. 3*a*.

Figure 4A:
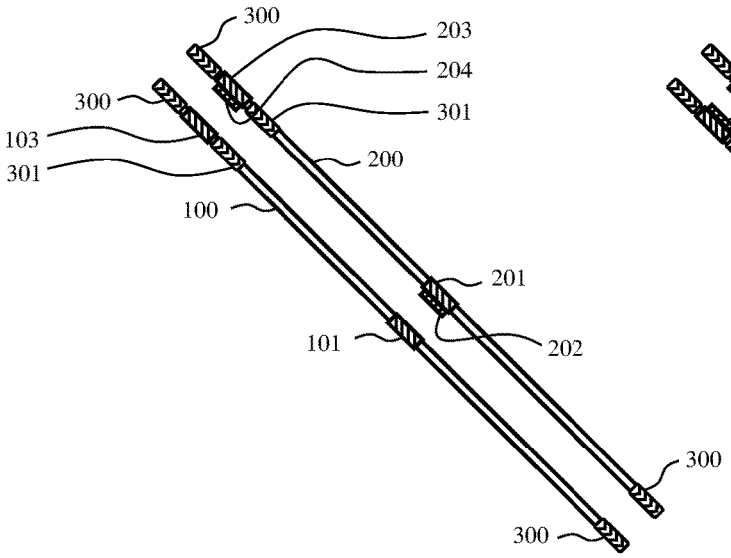
FIG. 4*a*: Illustration of another preferred embodiment of the present invention.

FIG. 4*a* illustrates another embodiment of the present invention which adds a feature to the first embodiments (of FIGS. 3*a* and 3*b*) that helps to conveniently maintain the two sticks together for example, during storage or while handling. Additional sleeves 103 and 203 are positioned near one end of the first stick 100 and second stick 200, respectively. The sleeve 203 of the second stick 200 is further equipped with a magnet 204 that can magnetically couple to the sleeve 103 of the first stick 100. It is noted that unlike the freely sliding sleeves 101 and 201, the sleeves 103 and 203 are characterized as non-sliding, as they are positioned and confined near one end of the sticks, in between the endcaps 300 and element 301. Element 301 is simply a collar-like component that is rigidly attached onto the sticks in a suitable position to serve as a confinement mechanism for the sleeves 103 and 203. The positioning of the collar 301 prevents the sleeves 103 and 203 from sliding along the length of the sticks but still allows them to freely rotate around the axis of the sticks. This facilitates the coupling of the two sleeves 103 and 203 and consequently the coupling of the two sticks 100 and 200 while handling or storing them. When simultaneously combined with the coupling of the two sleeves 101 and 201, the coupling of the two sticks 100 and 200 becomes even more secure for handling or during storage. For example, when the sticks are stored vertically in a golf bag, as in FIG. 5, placing the sticks with the non-sliding sleeves 103 and 203 in the up orientation allows the coupling of the two sticks 100 and 200 at the two far ends of the sticks, as the freely sliding sleeves 101 and 201 naturally slide down to the bottom ends of the sticks, thereby maximizing the securing of the sticks as a unit. The endcaps 300 as utilized in the embodiments of FIGS. 4*a* and 4*b* serve an additional purpose of preventing the sleeves 101, 201, 103, and 203 from sliding off the sticks 100 and 200.

Figure 4B:
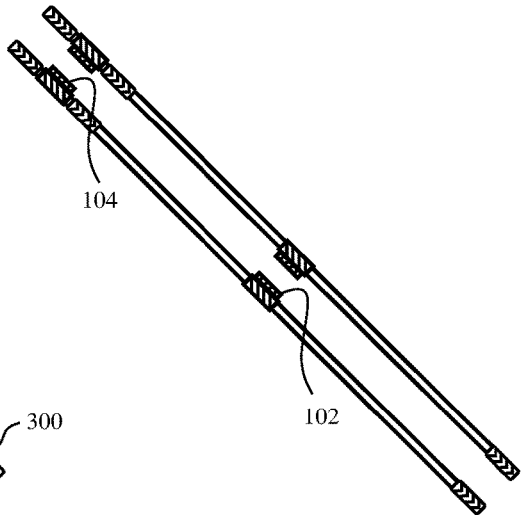
FIG. 4*b*: Illustration of yet another embodiment of the present invention.
Figure 5:
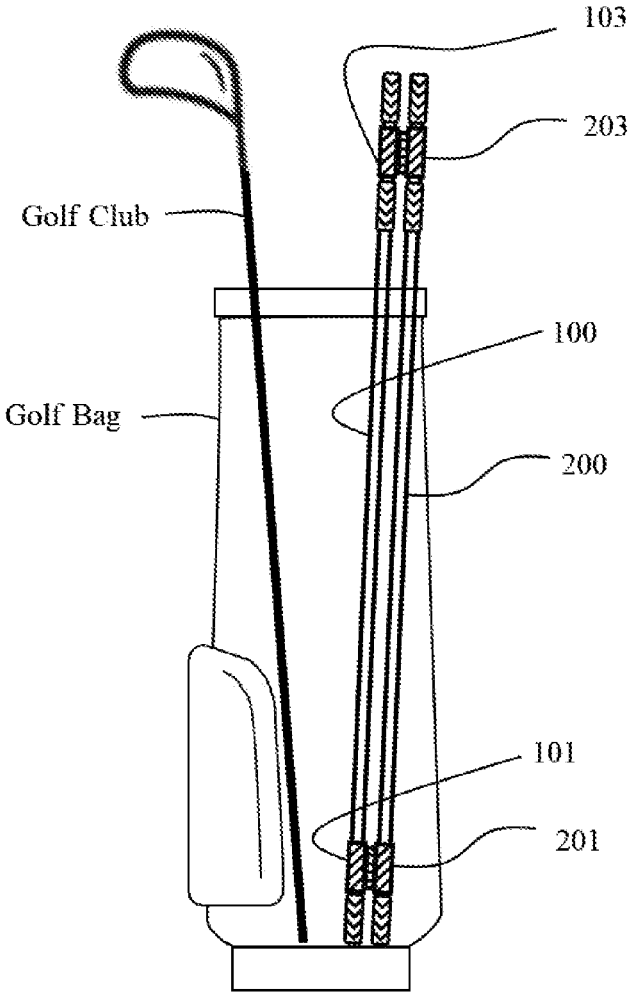
FIG. 5: Illustration of the preferred embodiment of FIG. 4*a*, shown as stored in a golf bag.

FIG. 4*b* illustrates yet another embodiment of the present invention and functions exactly the same as the embodiment of FIG. 4*a*. The only difference is indicated by the addition of the magnet 102 and magnet 104 onto the sleeves 101 and 103, respectively. As such, in this configuration, the coupling of the sleeves is achieved by magnet-to-magnet coupling rather than by magnet-to-sleeve coupling. Accordingly, and for simplicity, the magnet 102 and magnet 104 are the only elements that are designated with a reference identification in FIG. 4*b*, as all other elements are same as shown in FIG. 4*a*.

Referring back to FIGS. 3*a*, 3*b*, 4*a*, and 4*b*, additional descriptions of the various elements making up the two embodiments will be provided. Elements 100 and 200 as previously described are ordinary golf alignment sticks, most commonly made from fiberglass material, due mainly to its superior stiffness. While fiberglass is the material of choice for the present invention, other high stiffness materials can be used including wood, aluminum, and carbon fiber. Dimensionally, the most common length and diameter of ordinary golf alignment sticks are approximately 40-48 inches and 0.3 inches, respectively. While these are also the preferred dimensions for the present invention, it is noted that precise dimensions around these values are not critical. For practical purposes however, the length of the sticks should range from 6 to 60 inches and the diameter should range from 0.1 to 1 inch. Moreover, the cross-sectional geometry can be circular (i.e., a solid core and as implied by the diameter) or ring-like (i.e., a hollow core) with outer diameter that can range from 0.1 to 1 inch. The two ends of the sticks 100 and 200 can be made flat, tapered, or pointy and either covered or uncovered with a protective cap 300. Additional features applied to the sticks 100 and 200 are simple visual markings (not depicted in the drawings) made by ink, sticker, engraving, etc. placed along the length of the sticks to serve as additional visual aids for the user, as well as a clear, protective surface coating on the sticks.

The sliding sleeve 101 integrated onto the first stick 100 is necessarily made using a ferromagnetic material (for example, metals such as Ni, Fe, Co) with the preferred choice of the present invention being ferromagnetic steel, due to its wide availability and low cost. The ferromagnetic property of the sliding sleeve 101 allows it to couple magnetically with the magnet 202 integrated onto the sliding sleeve 201. The sliding sleeve 201 integrated onto the second stick 200 is also made using ferromagnetic steel as the preferred choice of the present invention, but can also be made using any non-ferromagnetic material such as plastic or non-ferromagnetic metal. The preferred choice of the type of magnet 202 is a magnet commonly known as rare earth magnet, which generally provides stronger magnetic coupling strengths than the more common ceramic or other permanent magnets. While using a single magnet is preferred for simplicity, more than one magnet may be used just as effectively.

The sliding sleeves 101 and 201 are made to be freely sliding along the length of the sticks 100 and 200, respectively, by making the inner diameter of the sleeves slightly larger than the diameter of the sticks 100 and 200, preferably by at least 0.01 inch, but smaller than the outer diameter of the endcaps 300 in order to avoid the sleeves 101 and 201 from sliding off the sticks 100 and 200. The practical length of the sleeves 101 and 201 can range from 0.2 to 4 inches with the preferred choice of the present invention being about 1 inch. While the geometric dimensions of the magnet 202 and 102 are not critical so long as they provide the proper magnetic strength, they are chosen to be comparable to the dimensions of the sleeve 201.

Integration of the magnet 202 onto the sliding sleeve 201, or magnet 102 onto the sliding sleeve 101, can be achieved in any suitable manner including for example, by wrapping the sleeve 201 and the magnet 202 as a combined unit using a plastic based film or tubing. It is noted that the exact nature of the way in which the magnet is integrated into the sleeve is not critical so long as the magnetic coupling strength is maintained to a useful level.

All characteristics of the sliding sleeves (101, 201) and the associated magnets (102, 202) described above also apply to the non-sliding sleeves (103, 203) and their associated magnets (103, 203), and hence need not be explicitly repeated.

Endcaps (or protective caps) 300 as previously described, are commonly used in ordinary golf alignment sticks for protection purpose. As the name suggests, endcaps simply cover the end of the sticks using its one-end-open and one-end-closed tube-like design. These are commonly made from vinyl or other plastic based material and commercially available in a wide range of sizes (diameter and length).

Element 301 was previously described as a collar-like component that is rigidly attached onto the sticks in a suitable position to serve as a confinement mechanism for the sleeves 103 and 203. This element 301 for example, can be made from the same material as the endcaps 300 or other material such as plastic or metal tubing.

While the embodiments of FIGS. 3*a* and 3*b* show only one set of the sliding sleeves, additional sets of sliding sleeves can be added for redundancy or to provide more options for the user. Similarly the embodiments of FIGS. 4*a* and 4*b* can also be augmented with additional sets of sliding and/or non-sliding sleeves.

Figure 2:
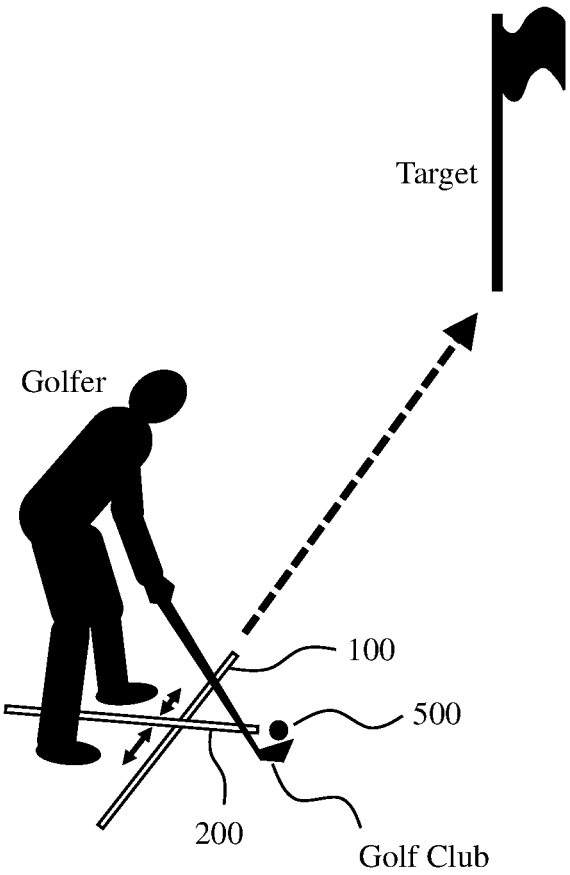
FIG. 2: Schematic illustration depicting a typical way in which a golfer uses a pair of golf alignment sticks as a training aid.

While FIGS. 1 and 2 describe the stick 100 as the one pointing to the target and stick 200 as being placed on top of and perpendicular to stick 100, it is understood (and likely obvious to the user) that other arrangements are equivalent in terms of the way the apparatus functions. For example, stick 100 could just as well be placed on top of stick 200. Similarly, stick 200 could be placed pointing to the target while stick 100 could be placed pointing to the golf ball. Likewise, in all cases, it should be obvious that either end of the stick can be used to point to the target or the golf ball without altering the way the apparatus functions.

Alternate mode of operation envisioned involves the use of additional sticks beyond the original pair of sticks. This can be achieved by simply integrating more than one sliding sleeve on the sticks, creating additional coupling units. For example, while the two sticks of the original pair are arranged in a cross-like pattern, a third stick can be coupled to the original first stick also in a cross-like pattern, creating an extra visual aid for the user to employ as he/she desires. Additional sticks (fourth, fifth, etc.) can be employed in a similar manner by integrating additional sliding sleeves to create the coupling units described in this disclosure.

INDUSTRIAL APPLICABILITY

The present invention transforms one of the most common golf training aids—alignment sticks—into an enhanced product equipped with highly functional and user-friendly features that encourage more frequent use of the product. Combined with the simplicity and convenience associated with the apparatus, this invention has the potential to be widely adopted by the golfing community and become the most standard product of its kind.

The invention claimed is:

1. A golf alignment training apparatus, comprising:

a first stick equipped with a sliding sleeve able to both freely slide along a length of the first stick as well as freely rotate around an axis of the first stick, wherein the sliding sleeve is made from a ferromagnetic steel material;

a second stick equipped with a sliding sleeve able to both freely slide along a length of the second stick as well as freely rotate around an axis of the second stick; and a magnet mounted onto the sliding sleeve of the second stick, allowing the sliding sleeve of the second stick to magnetically couple to the sliding sleeve of the first stick to form a magnetically coupled state, said magnet and said sliding sleeve of the first stick having corresponding coupling surfaces configured to allow the first stick and the second stick to be translationally and rotationally adjusted by freely sliding or rotating the coupled surfaces relative to each other while in said magnetically coupled state.

2. The apparatus of claim 1, wherein the first stick is equipped with additional sliding sleeves of the same type used in the first stick and the second stick is equipped with additional sliding sleeves of the same type used in the second stick.

3. A golf alignment training apparatus, comprising:

a first stick equipped with a sliding sleeve able to both freely slide along a length of the first stick as well as freely rotate around an axis of the first stick, wherein the sliding sleeve is made from a ferromagnetic steel material;

a second stick equipped with a sliding sleeve able to both freely slide along a length of the second stick as well as freely rotate around an axis of the second stick;

a magnet mounted onto the sliding sleeve of the second stick, allowing the sliding sleeve of the second stick to magnetically couple to the sliding sleeve of the first stick to form a magnetically coupled state, said magnet and said sliding sleeve of the first stick having corresponding coupling surfaces configured to allow the first stick and the second stick to be translationally and rotationally adjusted by freely sliding or rotating the coupled surfaces relative to each other while in said magnetically coupled state; and the first stick further equipped with a non-sliding sleeve along the length of the first stick but able to freely rotate around the axis of the first stick, wherein the non-sliding sleeve is made from a ferromagnetic steel material;

the second stick further equipped with a non-sliding sleeve along the length of the second stick but able to freely rotate around the axis of the second stick;

a magnet mounted onto the non-sliding sleeve of the second stick, allowing the non-sliding sleeve of the second stick to magnetically couple to the non-sliding sleeve of the first stick, helping to secure the first and second sticks together in a parallel configuration.

4. The apparatus of claim 3, wherein the non-sliding sleeves are limited in their movement along the length of the sticks by barriers placed on the sticks near both ends of the non-sliding sleeves.

5. A golf alignment training apparatus, comprising:

a first stick equipped with a sliding sleeve able to both freely slide along a length of the first stick as well as freely rotate around an axis of the first stick;

a second stick equipped with a sliding sleeve able to both freely slide along a length of the second stick as well as freely rotate around an axis of the second stick; and a magnet mounted onto the sliding sleeve of the first stick and a magnet mounted onto the sliding sleeve of the second stick, allowing the two said sliding sleeves to magnetically couple to each other to form a magnetically coupled state, said magnet of the sliding sleeve of said first stick and said magnet of the sliding sleeve of the second stick having corresponding coupling surfaces configured to allow the first stick and the second stick to be translationally and rotationally adjusted by freely sliding or rotating the coupled surfaces relative to each other while in said magnetically coupled state.

6. The apparatus of claim 5, wherein the first stick is equipped with additional sliding sleeves of the same type used in the first stick and the second stick is equipped with additional sliding sleeves of the same type used in the second stick.

7. The apparatus of claim 3, wherein the first stick is equipped with additional sliding sleeves of the same type used in the first stick and the second stick is equipped with additional sliding sleeves of the same type used in the second stick.

8. A golf alignment training apparatus, comprising:

a first stick equipped with a sliding sleeve able to both freely slide along a length of the first stick as well as freely rotate around an axis of the first stick;

a second stick equipped with a sliding sleeve able to both freely slide along a length of the second stick as well as freely rotate around an axis of the second stick;

a magnet mounted onto the sliding sleeve of the first stick and a magnet mounted onto the sliding sleeve of the second stick, allowing the two said sliding sleeves to magnetically couple to each other to form a magnetically coupled state, said magnet of the sliding sleeve of said first stick and said magnet of the sliding sleeve of the second stick having corresponding coupling surfaces configured to allow the first stick and the second stick to be translationally and rotationally adjusted by freely sliding or rotating the coupled surfaces relative to each other while in said magnetically coupled state; and the first stick further equipped with a non-sliding sleeve along the length of the first stick but able to freely rotate around the axis of the first stick;

the second stick further equipped with a non-sliding sleeve along the length of the second stick but able to freely rotate around the axis of the second stick;

a magnet mounted onto the non-sliding sleeve of the first stick and a magnet mounted onto the non-sliding sleeve of the second stick, allowing the two said non-sliding sleeves to magnetically couple to each other, helping to secure the first and second sticks together in a parallel configuration.

9. The apparatus of claim 8, wherein the non-sliding sleeves are limited in their movement along the length of the sticks by barriers placed on the sticks near both ends of the non-sliding sleeves.

10. The apparatus of claim 8, wherein the first stick is equipped with additional sliding sleeves of the same type used in the first stick and the second stick is equipped with additional sliding sleeves of the same type used in the second stick.

* * * * *